US005655472A

United States Patent [19]

Hagelstam et al.

[11] Patent Number: 5,655,472

[45] Date of Patent: Aug. 12, 1997

[54] ASYMMETRIC BRIDGE

[75] Inventors: Lennart Hagelstam, Esbo; Arjo Harjula, Espoo; Harri Eronen, Raisio, all of Finland

[73] Assignee: Finnyards Oy, Rauma, Finland

[21] Appl. No.: 446,714

[22] PCT Filed: Nov. 30, 1992

[86] PCT No.: PCT/FI92/00327

§ 371 Date: Aug. 11, 1995

§ 102(e) Date: Aug. 11, 1995

[87] PCT Pub. No.: WO94/12383

PCT Pub. Date: Jun. 9, 1994

[51] Int. Cl.[6] ..... B63B 1/00

[52] U.S. Cl. ..... 114/56

[58] Field of Search ..... 114/56, 65 R, 114/71, 72, 270

[56] References Cited

U.S. PATENT DOCUMENTS

| | | | |
|---|---|---|---|
| 3,138,131 | 6/1964 | Szychlinski | 114/72 |
| 3,447,502 | 6/1969 | Leopold | 114/261 |

*Primary Examiner*—Jesus D. Sotelo
*Attorney, Agent, or Firm*—Kubovcik& Kubovcik

[57] ABSTRACT

An asymmetric bridge of a ship where the main navigation workstation is located aside the center line of the ship on the starboard side of bridge at the starboard end of the bridge. The front bulkhead of the bridge is directed from the main navigation workstation to the port side of the ship in an angle abaft the beam. The aft bulkhead of the bridge is directed from the main navigation workstation to the port side of the ship in an angle between the direction of center line of the ship. The angle is preferably 10°–15° and the angle 40°–45°. The angle of the field of vision is about 320° seen along the bulkheads of the bridge.

9 Claims, 4 Drawing Sheets

ASYMMETRIC BRIDGE

BACKGROUND OF THE INVENTION

This invention relates to a bridge of a ship and more particularly to an asymmetric bridge where the main navigation workstation is located aside the center line of the ship on the starboard side or on the port side of bridge.

When designing the bridge form for a ship the most important factors to be considered are the overall view required from the inside of the bridge and the field of vision required from each workstation. For safe navigation and maneuvering of the ship it is necessary that all objects of interest for navigation, such as ships, lighthouses, etc., can be seen in any direction from inside the wheelhouse.

The workstations for navigation and traffic surveillance/maneuvering are prescribed in the Det Norske Veritas regulations. Additionally, according to those rules, other workstations are needed such as:

workstations for conning;

workstations for route planning;

workstations for manual steering;

workstations for docking; and workstations for performance of additional functions.

The bridge of the traditional merchant vessel is symmetric. Normally the main navigation workstation is located in the center of the bridge. The simple steering workstations may be added on both sides of the bridge at bridge wings for docking. This same arrangement is still used also on the bridge of the modern passenger ship.

In some cases like in the modern icebreakers the main navigation workstations are situated on both wings and a simple steering workstation is in the middle. This arrangement, however, is complicated and takes lots of room because all the systems must be duplicated.

To avoid double systems on the bridge the asymmetric bridges have been used. The main navigation workstation is in that case located asymmetrically on starboard side because of collision regulations. The vessels shall normally allow sufficient space for safe passing to the vessels coming from starboard side.

Modern research vessels have been equipped with asymmetric bridges because a long side wing provides a good visibility toward the stern of the ship. For the same reason some modern one man bridges for cargo ships have also been asymmetric.

However, modern asymmetric bridges also have disadvantages. The asymmetric bridge form considerably limits the view seen from the main navigation workstation. To fulfill the requirements for the field of vision according to the international rules and for example Det Norske Veritas rules for one man bridge regulations the different workstations must be located in the different parts of the bridge. The view from the bridge is also limited by the superstructures, funnels and stairways which limit sight especially aftship.

Besides for navigation and maneuvreing the sight aft and around the ship is also needed when working for example on the work deck aft, on the helideck, by the side doors, on rescue equipment area and with the research equipment, etc. Good aft and around sight also makes it possible to control the deck equipment like cranes, winches, research equipment etc. It also reduces the manning at the bridge and adds cooperation in different operations even in that amount that the often used aft wheelhouse can be left away.

By using the asymmetric bridge design it is possible to gain sight which is superior compared to the present bridge design. It is also possible to concentrate many operations to be controlled by one main workstation on the starboard side. The consequences are that the manning on the bridge can be reduced. Due to the good sight at least the following workstations at the bridge can be combined:

workstation for navigation.

workstation for traffic surveillance/maneuvreing workstation for manual steering;

workstation for docking operations;

workstation for conning; and workstation for performance of additional operations like crane and winch controls
dynamic positioning control
research equipment control
helideck control
work deck operations control, etc.

Normally only a secondary docking workstation on the port side is needed for harbour operations and for special operations.

The unobstructed sight has been achieved by placing the main workstation as far as possible away from all obstructing structures like stairways, lift if used, funnel etc. which will be located on the port side corner of the bridge. By this arrangement the blind sector will be minimized.

Also by forming the bridge bulkheads in line in the direction of sight so that they widen toward the comer where the obstructions are the excellent sight can be achieved. Also by placing all the extra workstations like the workstation for safety operations, for radio, for machinery and for navigation into this blind sector this superior field of sight has been made possible.

The best results for the good sight close to the vessel can be achieved by also having an at least partly asymmetric deckhouse.

SUMMARY OF THE INVENTION

According to the invention the bulkheads of the bridge are so directed that from the windows of the main navigation workstation can be seen to the reverse side of the ship ahead of the front bulkhead of the bridge in an angle abaft the beam, and/or to the stern and to the aft deck of the ship in the direction that forms an angle between the direction of the center line of the ship.

The above and other features and advantages of this invention will become better understood by reference to the detailed description that follows, when considered in connection with the accompanying drawings.

DETAILED DESCRIPTION OF A PREFERRED EMBODIMENT

Figure 1:
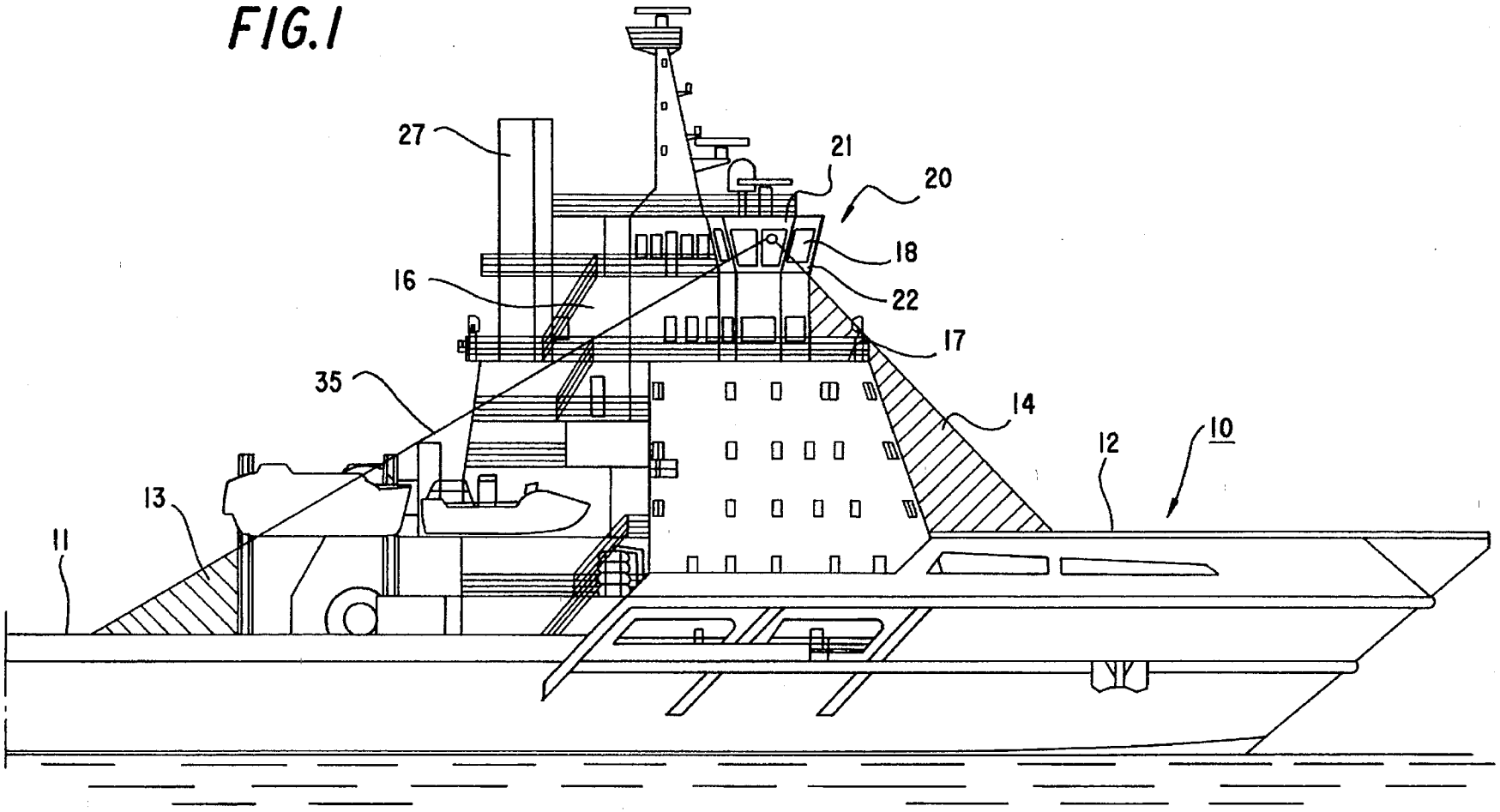
FIG. 1 presents a ship seen from the side equipped with an asymmetric bridge according to the invention.

In FIG. 1 is shown a ship 10 seen from side equipped with an asymmetric bridge 20 according to the invention. The main navigation workstation 21 is placed on the starboard side into a wing 22 such that a navigator on the bridge can see to the aft deck 11 and the fore deck 12. The vertical blind sectors 13 and 14 are very small as can be seen in FIG. 1.

Figure 2:
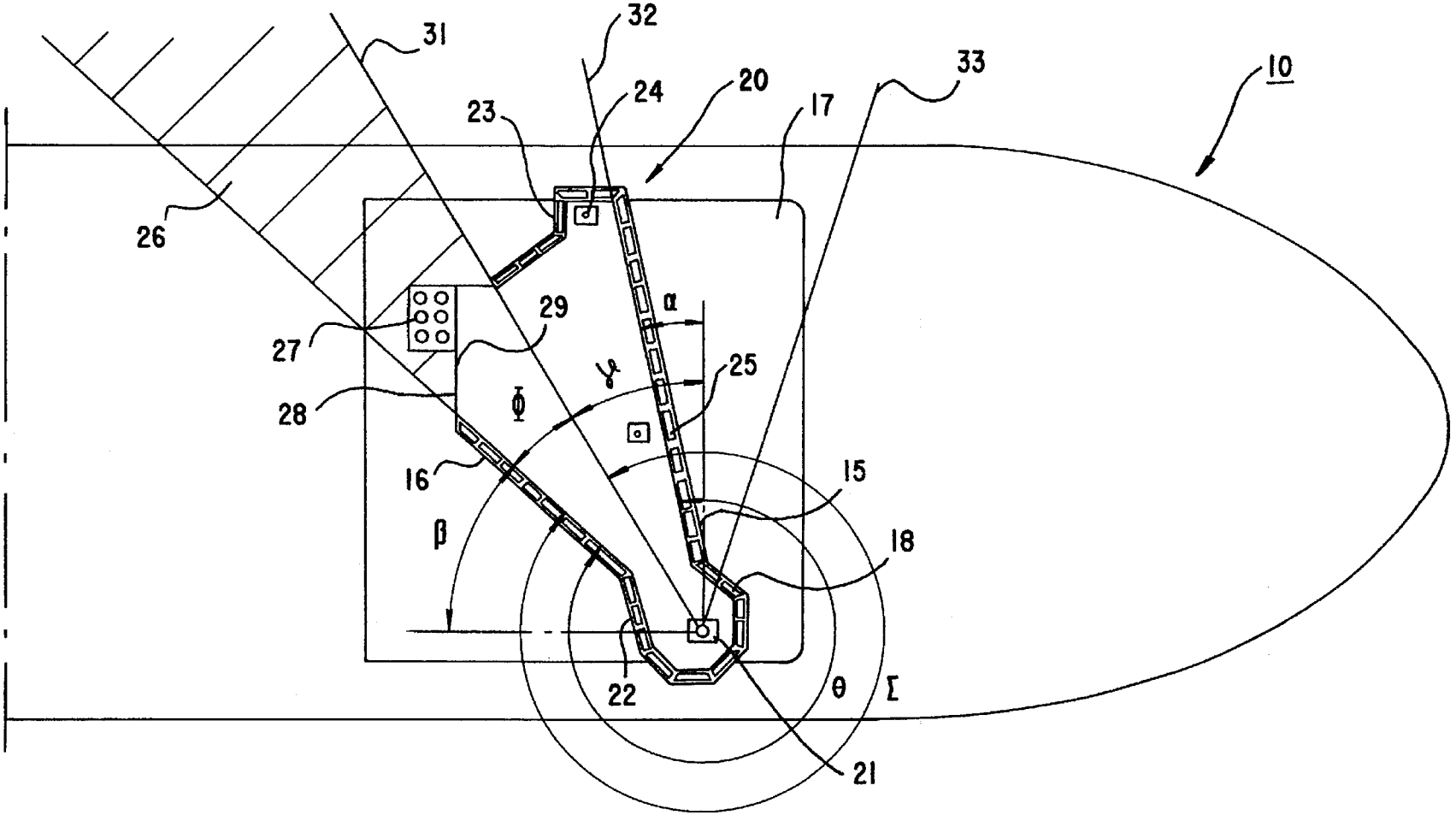
FIG. 2 presents a sectional view of the ship according to FIG. 1 seen from top.

In FIG. 2 is shown the ship 10 of FIG. 1 seen from top and the sectional view of the bridge 20. The form of the bridge 20 is asymmetric so that the main navigation workstation 21 is on the starboard side in a wing 22.

One man can navigate the vessel at the main navigation workstation 21 fulfilling Det Norske Veritas regulation requirements for one man bridge W1. The workstation console is normally arranged either for one man or for two men. The workstation 21 console is formed in a way that it is easily possible for the navigator to walk around the console in order to get the best possible sight and to facilitate handling of the navigation equipment. Of course the console can also be located directly against the bulkheads depending on the size and use of the vessel. The forward and aft bulkheads are placed in an angled position so that the angle $\Phi$ of the blind sector is minimized in view of both bulkheads.

In FIG. 2 it can be seen that the field of vision is not only directed forward and to both sides but also aft. According to IMO's International Regulations for Preventing Collisions at Sea the horizontal field of vision should extend at least over an arc from; 22.5° abaft the beam on the side, through forward, to 22.5° abaft the beam on the other side. In FIG. 2 the horizontal field of vision extends at an angle $\tau$ which is about 30° abaft the beam on the port side. On the starboard side the angle is much larger.

In the ship 10 of FIG. 2 the port side wing 23 of the bridge 20 is equipped with a secondary navigation workstation 24. The field of vision is unobstructed to fore ship, to aft ship and to port side bulwark because all the bulkheads are equipped with windows 18 in order to facilitate easy harbour maneuvreing. Only the main workstation 21 is normally equipped for normal navigation. This arrangement reduces the amount of navigation equipment and saves costs.

On center line of the bridge 20 there is another secondary steering workstation 25 with a sight to fore ship and also aft. This workstation 25 is meant for so called line navigation and it is normally equipped with a steering device and a compass.

In the horizontal blind sector 26 of the main navigation workstation 21 the following objects are located:

chart table;

radio center;

machinery control;

office space; and safety center etc.

This arrangement also makes it possible to place the equipment and the space needing illumination as far as possible from the main navigation workstation 21. Typical of such spaces are the stairs to the bridge deck, toilet, the lift and the pantry. The funnel 27 is preferably placed outside the wheelhouse 28 in the blind sector. In special cases the whole wheelhouse 28 can be built like a mirror image so that the main navigation workstation 21 is located on the port side.

All the bulkheads of the bridge 20 in the ship 10 of FIG. 2 are equipped with windows 18 except the bulkhead 29 in the blind sector where the windows are optional. Therefore the horizontal view angle $\Sigma$ of the field of vision can be up to about 345°, almost around the horizon. The blind sector angle $\Phi$ is only about 15°–20°.

Figure 3:
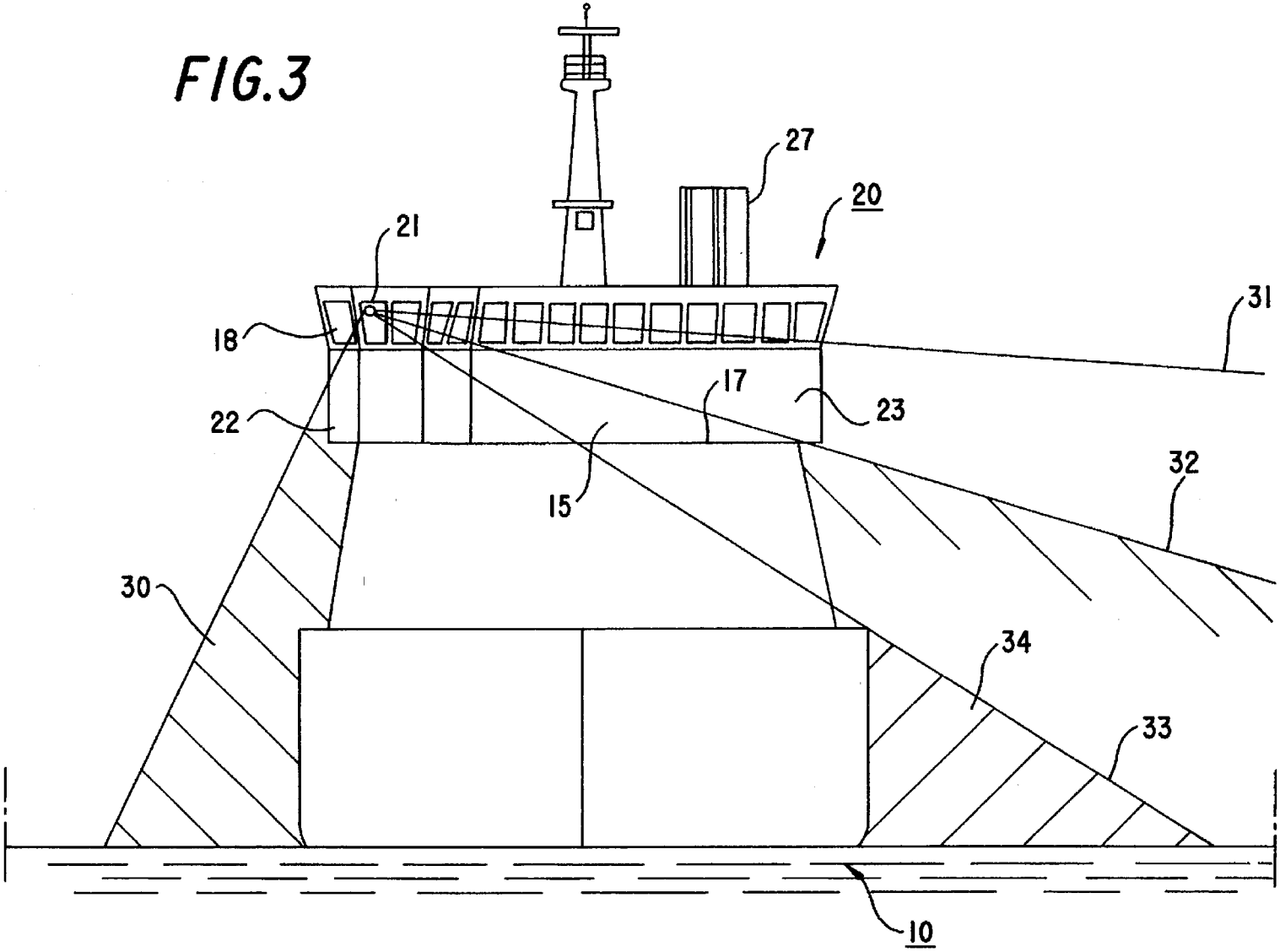
FIG. 3 presents the ship according to FIG. 1 seen from the bow.

In FIG. 3 it can be seen that on starboard side the navigator can see water very close to the ship from the main navigation workstation 21. The vertical blind sector 30 is not very large. Of course the navigator can walk around the main navigation workstation 21 to have an even better view to the ship side for instance when docking is taking place. On the port side the vertical blind sector is under the sector line 31 in FIG. 2 and FIG. 3 when looking from the main navigation workstation 21 through the port side window of the bridge.

According to the invention the field of vision is so large on the bridge 20 because the front bulkhead 15 of the bridge 20 is directed in an angle $\alpha$ of about 12° abaft the beam on the port side. Also the angle $\beta$ between the aft bulkhead 16 of the bridge 20 and the direction of center line of the ship is about 42° on the starboard side.

When the navigator looks out of the window 18 to the port side along the front bulkhead 15 of the bridge 20 only the deck of the lower deckhouse deck 17 limits the vertical field of vision. The sector line 32 illustrates the vertical border of the field of vision in FIG. 3 and the horizontal border of the field of vision in FIG 2. If the ship 10 is not provided with the overhanging lower deckhouse deck 17 or the deck 17 is designed to be more inclined only the fore deck 12 of ship 10 and the sector line 33 limits the vertical border of the field of vision. In that case on the port side there is only a small blind sector 34.

Figure 4:
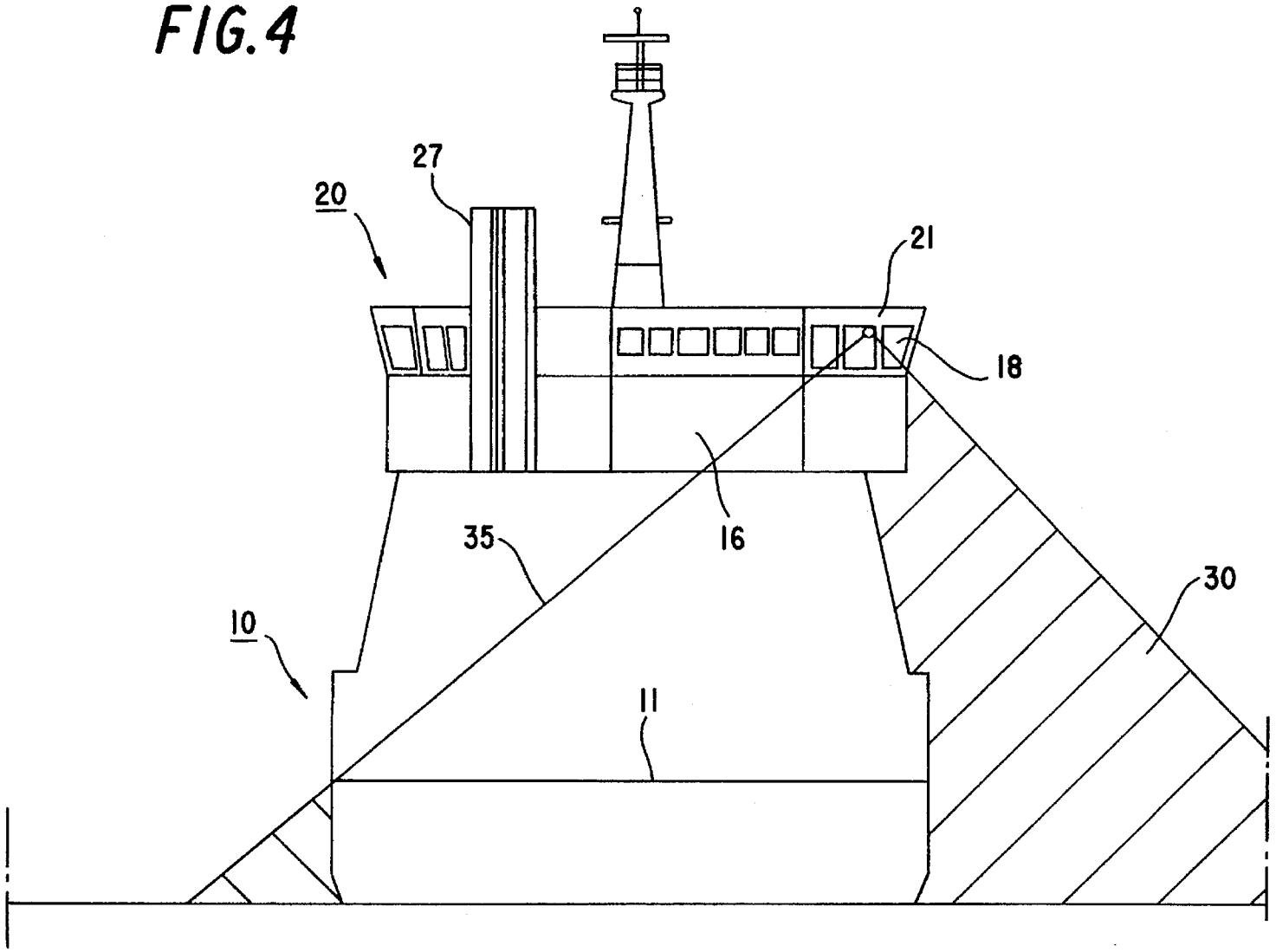
FIG. 4 presents the ship according to FIG. 1 seen from the stern.

In FIG. 4 the ship 10 seen is shown as from stem. The vertical field of vision on the sides of the ship extends very close to the ship. The sector line 35, seen in FIG. 1 and in FIG. 4, is directed along the aft bulkhead 16 of the bridge 20. As it can be seen in FIG. 1 the stern deck 11 is very well in the field of vision. According to the invention a large field of vision around the ship 10 is achieved from the main navigation workstation 21 so that there is no need for the navigator to move anywhere from his place.

We claim:

1. A bridge of a ship having an asymmetric form, said bridge comprising:

front and aft bulkheads defining a main navigation workstation located on one side of a center line of a ship, said front and aft bulkheads being arranged such that through windows of said workstation a navigator can see an opposite side of the ship ahead of said front bulkhead at an angle abaft a beam of the ship and to a stern and to an aft deck of the ship in a direction corresponding to an angle formed between the center line of the ship and said aft bulkhead.

2. The bridge of claim 1, wherein the main navigation workstation is located at a starboard end of the bridge and the front bulkhead is directed from the main navigation workstation toward the port side of the ship at an angle abaft the beam.

3. The bridge of claim 1, wherein the main navigation workstation is located at a starboard end of the bridge and the aft bulkhead is directed from the main navigation workstation toward the port side of the ship in a direction that forms an angle relative to the center line of the ship.

4. The bridge of claim 1, wherein the angle between the front bulkhead and the beam of the ship is 10°–15°.

5. The bridge of claim 1, wherein the angle between the aft bulkhead and the direction of center line of the ship is 40°–45°.

6. The bridge of claim 1, wherein the front and aft bulkheads are arranged so that from the main navigation workstation a navigator can see in the direction of the front and aft bulkheads.

7. The bridge of claim 1, wherein a horizontal field of vision a navigator can see from the main navigation workstation along the bulkheads of the bridge defines an angle of about 320°–330°.

8. The bridge of claim 1, wherein a horizontal field of vision a navigator can see from the main navigation workstation on the bridge defines an angle of about 330°–345°.

9. The bridge of claim 1, wherein a blind sector angle of a horizontal field of vision a navigator can see from the main navigation workstation on the bridge defines an angle of about 15°–20°.

* * * * *